US007086123B2

(12) United States Patent
Carter

(10) Patent No.: US 7,086,123 B2
(45) Date of Patent: Aug. 8, 2006

(54) CUFF CLIP JEWELRY DEVICE

(76) Inventor: Bobby J. Carter, 236 Old Springs Rd., Fort Mill, SC (US) 29715

( * ) Notice: Subject to any disclaimer, the term of this patent is extended or adjusted under 35 U.S.C. 154(b) by 69 days.

(21) Appl. No.: 10/912,072

(22) Filed: Aug. 6, 2004

(65) Prior Publication Data

US 2006/0026990 A1 Feb. 9, 2006

(51) Int. Cl.
*A41F 17/00* (2006.01)

(52) U.S. Cl. ..... 24/72.1

(58) Field of Classification Search ..... 24/3.1, 24/72.1, 298–302, 305, 41.1–55, 66.2; 2/309, 2/321, 323; 63/1.11, 1.16, 1.18, 14.1, 14.4, 63/14.5, 12, 33, 40
See application file for complete search history.

(56) References Cited

U.S. PATENT DOCUMENTS 766,026 A * 7/1904 Easton ..... 24/299
868,567 A * 10/1907 Jensen ..... 24/299
898,503 A 9/1908 Plummer ..... 24/299
1,432,780 A * 10/1922 Ordakowski ..... 24/327
1,465,180 A * 8/1923 Rowe ..... 24/301
1,782,057 A 11/1930 Bollinger ..... 24/301
2,519,980 A * 8/1950 Renz ..... 248/211
3,822,446 A * 7/1974 Siverstein ..... 24/3.5
3,940,144 A * 2/1976 Dickie ..... 24/298
6,618,862 B1 9/2003 Bunjes ..... 24/299
6,701,582 B1 * 3/2004 Milburn ..... 24/72.1

* cited by examiner

*Primary Examiner*—Robert J. Sandy
*Assistant Examiner*—Ruth C. Rodriguez
(74) *Attorney, Agent, or Firm*—Richard C. Litman

(57) ABSTRACT

A cuff clip jewelry device is provided in the form of a spring-biased cuff clamp having a decorative charm adhesively secured thereon and a U-shaped shoe clip connected to the cuff clamp with a detachable length of sterling silver chain. The cuff clamp is attached to the cuff of a baggy pant leg and the shoe clip is slipped onto the upper portion of the back of a shoe. The jewelry device prevents the cuff of the baggy pant leg from dropping below the heel of the shoe and being dragged on the ground.

6 Claims, 2 Drawing Sheets

CUFF CLIP JEWELRY DEVICE

BACKGROUND OF THE INVENTION

1. Field of the Invention

The present invention relates to clothing accessories, and more particularly to a cuff clip jewelry device that functions to protect the cuffs of unaltered or baggy-style pants from being dragged along the ground and stepped on, and also serving as an fashionable adornment for the wearer of the pants.

2. Description of the Related Art

When people wear pants that have not been properly altered in length or pants made in today's baggy style, the cuffs of the pants sometimes extend below the heels of the wearers shoes where they are drag along the ground and stepped on during walking. This causes the cuffs of the pants to become excessively dirty, stained and prematurely worn out from abrasion against the ground.

Clip-like devices for holding the cuffs of pants and shirtsleeves have been invented in the past. U.S. Pat. No. 898,503 issued Sep. 15, 1908 to Plummer, U.S. Pat. No. 1,782,057 issued Nov. 18, 1930 to Bollinger and U.S. Pat. No. 6,618,862 B1 issued Sep. 16, 2003 to Bunjes are examples of the cuff holding devices of the past. These devices, although suitable for their intended purposes, fail to provide a secure attachment to the shoes and pant cuffs, while also serving as a fashionable adornment for the wearer of the baggy pants like the present invention as will become evident from the following disclosure.

None of the above inventions and patents, taken either singly or in combination, is seen to describe the instant invention as claimed. Thus a cuff clip jewelry device solving the aforementioned problems is desired.

SUMMARY OF THE INVENTION

The cuff clip jewelry device prevents the cuffs of long and baggy pant legs from dropping below the heels of the shoes and being dragged upon the ground. A spring-biased cuff clamp is provided with an adhesively attached decorative charm and is attached to a U-shaped shoe clip by a detachable sterling silver chain. The cuff clamps are attached to the cuffs of a wearer's pant legs and the shoe clips are attached to a wearer's shoes.

Aspects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
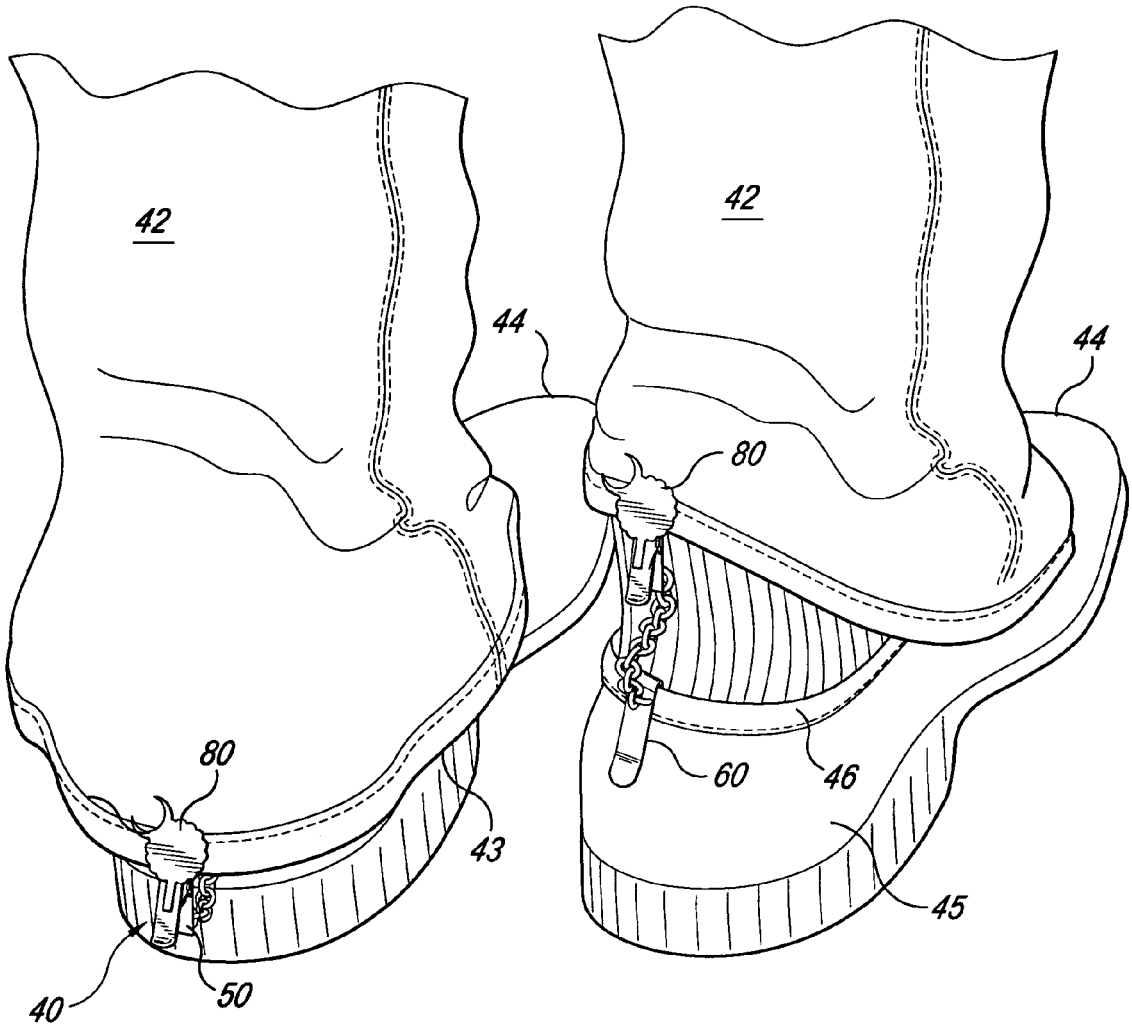
FIG. 1 is an environmental, perspective view of the cuff clip jewelry device according to the present invention.

The present invention is cuff clip jewelry device 40 for use, as shown in FIG. 1, in preventing the cuffs of long and baggy pant legs from dropping below the heels of a wearer's shoes 44. Device 40 includes a chain 70 connecting a cuff clamp 50 to a shoe clip 60. Cuff clamps 50 are attachable to the cuffs 43 of pant legs 42 and shoe clamps 60 are attachable to an upper portion 46 of the backs 45 of shoes 44.

Figure 2:
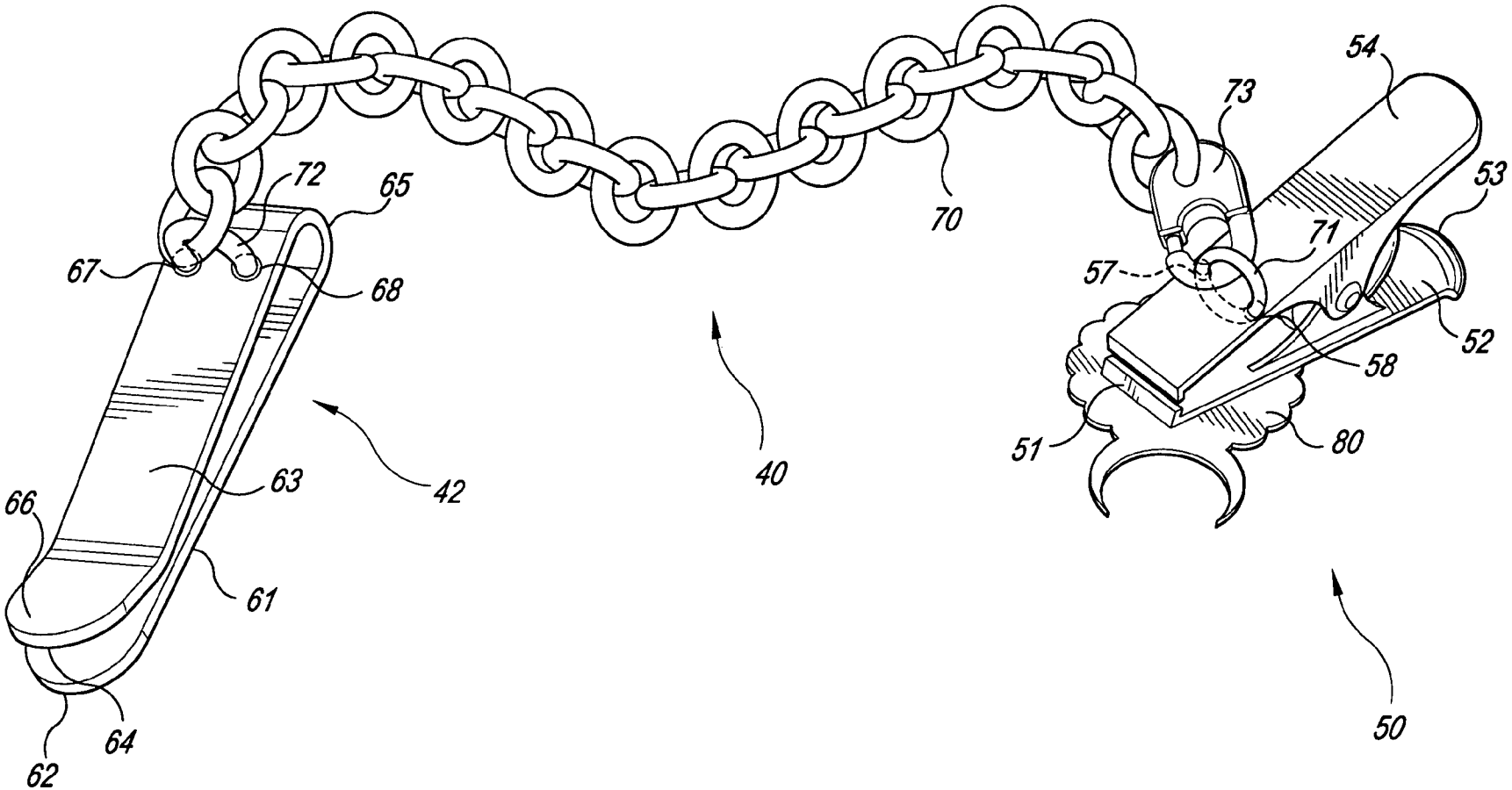
FIG. 2 is an enlarged perspective view of the cuff clip jewelry device according to the present invention.

Cuff clamps 50 are preferably provided in the form of commercially available spring-biased alligator-type clamps. Badge clip No.2518-00-80 manufactured by Craft, Inc. is an example of the kinds of alligator-type clamps suitable for use with the present invention. Clamp 50, as seen in FIG. 2, has a first end 51, a second end 53, a first side 52 and a second side 54. Jaws 55 and 56 are formed on the first end 51 for securely grasping a cuff 43 of a pant leg 42 there between.

A decorative charm 80 is secured material to the first side 52 of the cuff clamp 50 by a suitable adhesive. The charm 80 may be formed of any suitable material in any decorative shape and may further include gemstones. The clamp 50 can be formed from any suitable material, but is, preferably, formed from nickel-plated stainless steel.

Shoe clip 60 is a one-piece U-shaped clip formed from flat stock having a first leg 61 with a rounded distal end 62 and a substantially flat second leg 63 with a rounded distal end 64. The proximal ends of first leg 61 and second leg 63 are connected by a bend 65. Rounded end 64 is bent slightly outwards to form a guide 66 to facilitate insertion of clip 60 over the upper portion 46 of the back 45 of a shoe 44. When placed on the back 45 of a shoe, the bend 65 is positioned to provide comfortable walking movement of a foot without injuring the Achilles tendon.

Detachable means are provide for connecting cuff clamp 50 to shoe clip 60. Preferably, the detachable means is provided in the form of a first pair of holes or apertures 57, 58 formed in the second side 54 of clamp 50 adjacent the first end 51 and a second pair of holes or apertures 67, 68 formed in the second leg 43 of the shoe clip 60 adjacent bend 65. However, any suitable mechanism such as an eyelet welded to or integrally formed on the cuff clamp 50 and shoe clip 60 may be used instead of apertures 57,58,67 and 68.

The detachable means further includes a first jump ring 71 mounted in apertures 57, 58 of cuff clamp 50, a second jump ring 72 mounted in apertures 67, 68 of shoe clip 60 and a chain 70 connected at one end to jump ring 72 and connected at a second end to a lobster clasp 73. The lobster clasp 73 is detachably coupled to the first jump ring 71. The chain 70, jump rings 71, 72 and lobster clasp are preferably made of sterling silver. As best seen in FIG. 1, the placement of apertures 57, 58 near to the jaws 55, 56 prevents the cuff clamp 50 with decorative charm 80 attached from being pulled under the pants by the chain when worn. The lobster clasp 73 allows the shoe clip 60 to be removably connected to cuff clamps 50 that have different decorative charms 80 adhesively secured thereon.

It is to be understood that the present invention is not limited to the embodiment described above, but encompasses any and all embodiments within the scope of the following claims.

I claim:

1. A cuff clip jewelry device comprising:

a spring-biased cuff clamp having a first side, a second side, a first end and a second end;

a decorative charm adhesively secured on said second side of said cuff clamp;

a one piece U-shaped shoe clip formed from flat stock having a first leg connected by a bend to a V-shaped second leg, wherein said first leg has a first rounded distal end, said second leg has a second rounded distal end, said first leg and said second leg are connected by a bend and said second rounded distal end is angularly bent to form a guide to facilitate insertion of said shoe clip over an upper portion of a back of a shoe; and detachable means for connecting said second leg of said shoe clip to said second side of said cuff clamp, wherein said detachable means comprises:

a first pair of apertures formed in said second side of said clamp adjacent said first end and a second pair of apertures formed in said second leg of said shoe clip adjacent said bend;

a first jump ring mounted in said first pair of apertures of said cuff clamp;

a second jump ring mounted in said second pair of apertures of said shoe clip; and a chain having a lobster clasp at one end and connected at a second end to said second jump ring.

2. The cuff clip jewelry device according to claim 1, wherein said cuff clamp is formed of nickel-plated stainless steel.

3. The cuff clip jewelry device according to claim 1, wherein said chain, said lobster clasp and said first and second jump rings are formed from sterling silver.

4. The cuff clip jewelry device according to claim 3, wherein said cuff clamp is formed of nickel-plated stainless steel.

5. A cuff clip jewelry device, comprising:

a spring-biased cuff clamp, said cuff clamp having a front portion, a back portion, a first end and a second end, said cuff clip including jaws formed on said front and back portions adjacent said first end and a first pair of holes formed in said back portion adjacent said first end of said clamp to facilitate attachment to the hem of a pant leg;

a first jump ring mounted in said first pair of holes;

a decorative charm adhesively secured to said front portion of said clamp;

a U-shaped shoe clip, said shoe clip having an inner leg having a first rounded distal end connected at a proximal end by a bend to a proximal end of an outer leg also having a rounded distal end, said distal end of said outer leg being bent at an angle to facilitate attachment of said shoe clip over an upper portion of the back of a shoe, a second pair of holes formed in said outer leg adjacent said bend;

a second jump ring mounted in said second pair of holes; and a sterling silver chain having a first end and a second end, a sterling silver lobster clasp connected to said first end, wherein said lobster clasp is detachably connected to said first jump ring and said second end of said chain is connected to said second jump ring.

6. The cuff clip jewelry device according to claim 5, wherein said cuff clamp is formed of nickel-plated stainless steel.

* * * * *